US009701531B2

(12) United States Patent
Desch

(10) Patent No.: US 9,701,531 B2
(45) Date of Patent: Jul. 11, 2017

(54) FILLING HEAD FOR A LIQUID TANK

(71) Applicant: VERITAS AG, Gelnhausen (DE)

(72) Inventor: Christian Desch, Biebergemund (DE)

(73) Assignee: VERITAS AG, Gelnhausen (DE)

( * ) Notice: Subject to any disclaimer, the term of this patent is extended or adjusted under 35 U.S.C. 154(b) by 32 days.

(21) Appl. No.: 14/684,092

(22) Filed: Apr. 10, 2015

(65) Prior Publication Data

US 2016/0297669 A1 Oct. 13, 2016

(51) Int. Cl.
*B67D 7/42* (2010.01)

(52) U.S. Cl.
CPC ..... *B67D 7/42* (2013.01)

(58) Field of Classification Search
CPC ..... B67D 7/344; B67D 7/0288; B67D 7/42
USPC ..... 141/18, 21, 192, 198, 392
See application file for complete search history.

(56) References Cited

U.S. PATENT DOCUMENTS 8,235,078 B2 * 8/2012 Horlacher ..... B60K 15/04 141/350
8,857,643 B2 * 10/2014 Fetzer ..... B29C 45/006 206/818
8,919,393 B2 * 12/2014 Budzyk ..... B60K 15/04 141/290
9,285,254 B2 * 3/2016 Lauber ..... G01F 1/075
9,315,099 B2 * 4/2016 Whelan ..... B60K 15/04
2009/0321441 A1 * 12/2009 Horlacher ..... B60K 15/04 220/86.2
2011/0100985 A1 * 5/2011 Tsiberidis ..... B60K 13/04 220/86.2
2012/0181274 A1 7/2012 Fetzer
2013/0306665 A1 11/2013 Eberhardt et al.
2015/0135851 A1 * 5/2015 Lauber ..... G01F 1/075 73/861.77

FOREIGN PATENT DOCUMENTS

DE 102011009745 B4 8/2012
EP 2607133 A1 6/2013

OTHER PUBLICATIONS

EPO; European Search Report issued in corresponding EP 15161345.2, Aug. 17, 2015, 4 pages.

* cited by examiner

*Primary Examiner* — Nicolas A Arnett
(74) *Attorney, Agent, or Firm* — Loeb & Loeb LLP

(57) ABSTRACT

A filling head having a filler stub for a pump nozzle, having a magnet element, which is formed from a magnetic plastics material, for releasing an automatic pump nozzle mechanism of the pump nozzle.

11 Claims, 10 Drawing Sheets

FILLING HEAD FOR A LIQUID TANK

FIELD OF THE INVENTION

The present invention relates to a filling head for a liquid tank in a motor vehicle.

RELATED TECHNOLOGY

Publication DE 10 2011 009 745 B4 describes a filler stub for an auxiliary liquid container for a motor vehicle having an integral stub housing, which defines an orifice stub for a pump nozzle and a filling channel into the container, in which a receiving structure for a pump nozzle is provided within the stub housing. An integral inlet nozzle forms both an inlet channel of funnel-shaped configuration for the liquid to be introduced and part of a filler stub.

The integral formation of the inlet nozzle with the stub housing means that it can only be used for a particular filler stub of a predetermined geometry. For a filler stub of some other geometry, it is therefore necessary to produce a different, complex injection mould at great cost.

In order to prevent mix-ups between a fuel and an aqueous urea solution when filling the tank, urea pump nozzles for motor vehicles are fitted with a magnetic switch, which has the effect that the urea pump nozzle is not triggered without a magnet integrated in the filling head. To this end, current filling heads often comprise a metallic ring made from rare earths, which produces a permanent magnetic field.

SUMMARY

It is the object underlying the invention to indicate a filling head for a pump nozzle which can be produced with a low outlay and with a low weight.

This object is achieved by subject matter having the features in accordance with the independent claim. Advantageous embodiments of the invention form the subject matter of the figures, the description and the dependent claims.

According to one aspect of the invention, the object is achieved by a filling head having a filler stub for a pump nozzle, having a magnet element, which is formed from a magnetic plastics material, for releasing an automatic pump nozzle mechanism of the pump nozzle. The magnet element serves to trigger the pump nozzle. The filling head is a filling head for a liquid tank for an aqueous urea solution (SCR tank), for example. The plastics material is a thermoplastic material, for example. The technical advantage that the magnet element can be produced in any desired shape by injection moulding and has a high resistance to fluids is thereby achieved, for example. Moreover, corrosion of the kind which occurs when using rare earths is avoided.

In an advantageous embodiment of the filling head, the magnet element is a ring which is arranged around the filler stub. The technical advantage that a strong magnetic field can be produced in the interior of the filler stub is thereby achieved, for example.

In another advantageous embodiment of the filling head, the filling head comprises an assembled moulded dip tube body in the interior of the filling head, which comprises a first moulded body component for forming a filler stub for a filling nozzle and a second moulded body component for shaping a liquid jet of the filling nozzle, which is fastened on the first moulded body component. The moulded dip tube body can be inserted into the filling head. The technical advantage that a modular construction of the filling head is obtained is thereby achieved, for example, thus allowing filling heads of different design to be formed by combining different parts. In addition, the advantage is achieved that a liquid jet from different nozzle guns is standardized and one filling rate can be achieved.

In another advantageous embodiment, the moulded dip tube body, in particular the first moulded component and the second moulded component, together with a housing wall of the filling head, form a liquid reservoir for holding a liquid quantity. The technical advantage that the filling head can accommodate a quantity flowing out of the filling nozzle during topping up is thereby achieved, for example.

In another advantageous embodiment, the second moulded body component comprises an encircling circular anti-surge wall for reducing liquid flow into the liquid reservoir. The technical advantage that the liquid reservoir slowly fills with liquid and liquid is prevented from escaping is thereby achieved, for example.

In another advantageous embodiment, the encircling anti-surge wall comprises a passage opening for liquid flow into the liquid reservoir. The technical advantage that a liquid flow can be influenced by means of the size of the opening is thereby achieved, for example.

In another advantageous embodiment, the first moulded body component comprises an opening for allowing air out of the liquid reservoir. The technical advantage that the formation of a buffer which makes it more difficult for liquid to flow into the liquid reservoir is prevented is thereby achieved, for example.

In another advantageous embodiment, the opening is formed in the vicinity of a connection of the first moulded body component to the filling head. The technical advantage that the opening is situated at a location at which no liquid can escape through the opening is thereby achieved, for example.

In another advantageous embodiment, the moulded dip tube body has a cylindrical basic shape. The technical advantage that the moulded dip tube body can be formed with little outlay on material and in a compact way is thereby achieved, for example.

In another advantageous embodiment, a seal element is inserted between the first moulded body component and the second moulded body component for sealing off the filler stub. The technical advantage that liquid is prevented from escaping from the filling head is thereby achieved, for example.

In another advantageous embodiment, the seal element runs diagonally around a longitudinal axis of the filler stub. The technical advantage that the sealing effect of the filling head is improved by a lower-lying seal and that nozzle guns with a side opening can be switched is thereby achieved, for example.

In another advantageous embodiment, the seal element runs vertically around a longitudinal axis of the filler stub. The technical advantage that the vertical arrangement of the seal element allows the entire filling head to be of smaller design is thereby achieved, for example. Moreover, the vertical arrangement of the seal element allows the seal to be positioned in such a way that the automatic shut-off mechanism on all nozzle guns is free and hence that the pump nozzle can be used for tank filling with free rotation through 360°.

In another advantageous embodiment, the first moulded body component or the second moulded body component comprises a supporting surface for the seal element. The technical advantage that the leaktightness of the moulded body is improved is thereby likewise achieved, for example.

In another advantageous embodiment, the first moulded body component comprises a latching means for latching in the second moulded body component, or the second moulded body component comprises a latching means for latching in the first moulded body component. The technical advantage that the moulded dip tube body can be assembled in a simple manner is thereby achieved, for example.

In another advantageous embodiment, the second moulded body component comprises a stop portion for forming a stop for the filling nozzle. The technical advantage that the filling nozzle is prevented from penetrating too far into the filling head and that the position of the magnet for switching is secured is thereby achieved, for example.

In another advantageous embodiment, the moulded dip tube body is welded or adhesively bonded to the filling head. The technical advantage that a firm connection is obtained between the filling head and the moulded dip tube body is thereby achieved, for example.

In another advantageous embodiment, the first moulded body component comprises an encircling wall for laterally enclosing the second moulded body component. The technical advantage that both moulded body components engage positively in one another and that a mechanical connection between the two parts is improved is thereby achieved, for example.

In another advantageous embodiment, the first moulded body component or the second moulded body component is an injection moulding. The technical advantage that the moulded body component can be produced in a simple manner is thereby achieved, for example.

BRIEF DESCRIPTION OF THE DRAWINGS

Illustrative embodiments of the invention are shown in the drawings and are described in greater detail below. In the drawings.

DETAILED DESCRIPTION

Figure 1:
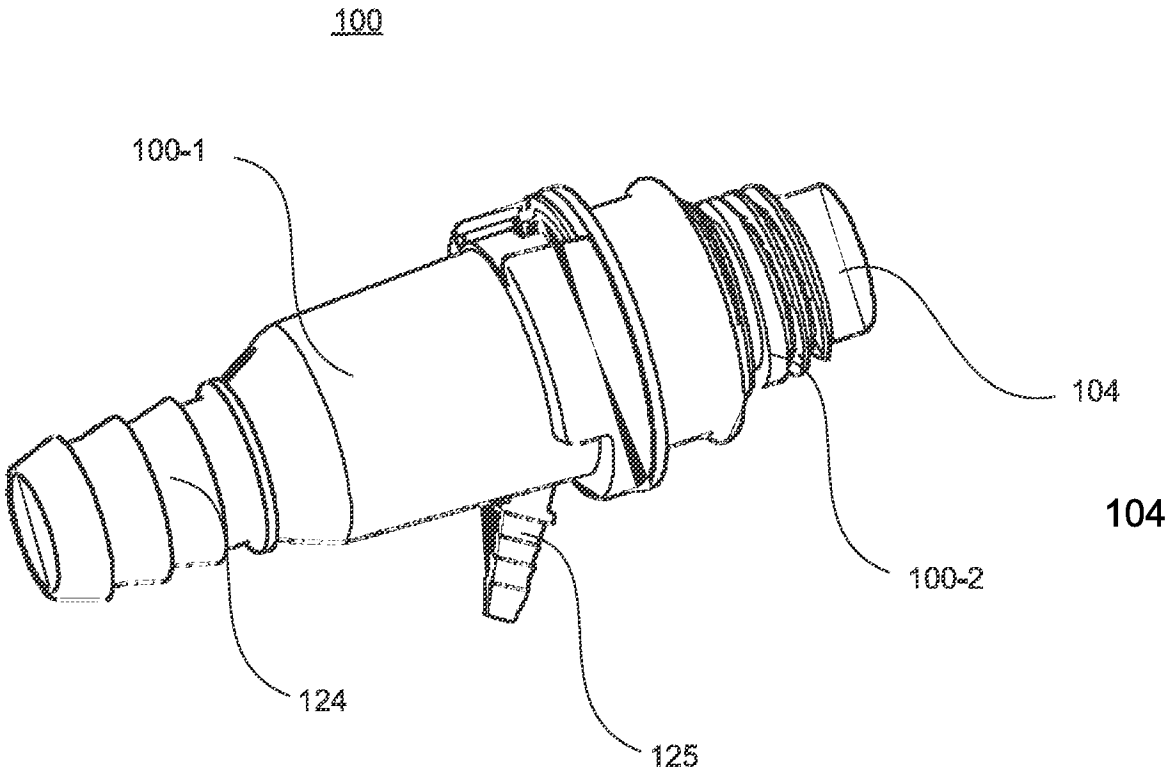
FIG. 1 shows a perspective view of a filling head.

FIG. 1 shows a perspective view of a filling head 100, e.g. for filling a liquid tank with an aqueous urea solution (SCR tank filling). An aqueous urea solution is used in motor vehicles for the after treatment of exhaust gases in an SCR catalyst. Here, the emission of nitrogen oxides is reduced by about 90% by selective catalytic reduction (SCR).

In the case of SCR tank filling, the aqueous urea solution is introduced into the liquid tank by means of nozzle guns of different configurations with a filling rate of up to 40 l/min. The intention here is to prevent the aqueous urea solution from escaping from the filling head 100 and to prevent the occurrence of "spit back". In addition, the intention is to avoid an escape of liquid even in the case of repeated topping up with a nozzle gun as a filling nozzle. In addition, SCR tank filling should be possible with a Kruse bottle screwed onto the filling head or an adapter for a canister.

The filling head 100 is formed by a first filling head part 100-1 and a second filling head part 100-2. The first filling head part 100-1 and the second filling head part 100-2 are connected to one another in a fluid- and pressure-tight manner and, in the interior, form a cavity in which a moulded dip tube body is inserted. In the interior of the filling head 100, the moulded dip tube body forms a further part of the filler stub 104. The moulded dip tube body receives a nozzle gun as a filling nozzle and positions it in the filling head 100. In addition, the moulded dip tube body delimits the jet of liquid emerging from the filling nozzle.

Moreover, the filling head 100 comprises a large connection stub 124 for connecting or pushing on a filler pipe or hose, which leads into a liquid tank, and a small connection stub 125 for connecting a ventilation line, which is used for air exchange or ventilation during tank filling by bottle if a bottle (Kruse bottle) is screwed pressure-tightly onto a thread of the filling head 100. FIG. 1 shows the filling head 100 from the outside without a holding plate and without the hoses pushed onto the connection stubs 124 and 125. For fastening on a vehicle body, the filling head 100 can additionally be fitted with a holding plate.

The filling head parts 100-1, 100-2 can be formed from thermoplastic elastomers (TPE) or elastomer alloys, for example, in particular from thermoplastic polyolefins, such as TPE-O (uncrosslinked thermoplastic polymers) or block copolymers, e.g. polyesters (TPE-E), polyamide elastomers (TPE-A), for example. Production from polyoxymethylene (POM) or polyamides and derivatives thereof is particularly advantageous since a particularly robust filling head 100 can thereby be obtained. It is advantageous to produce the individual parts of the filling head 100 by injection moulding in a technically simple way. All parts of the filling head 100 can comprise a material which prevents the formation of urea crystals on the surface thereof.

Figure 2:
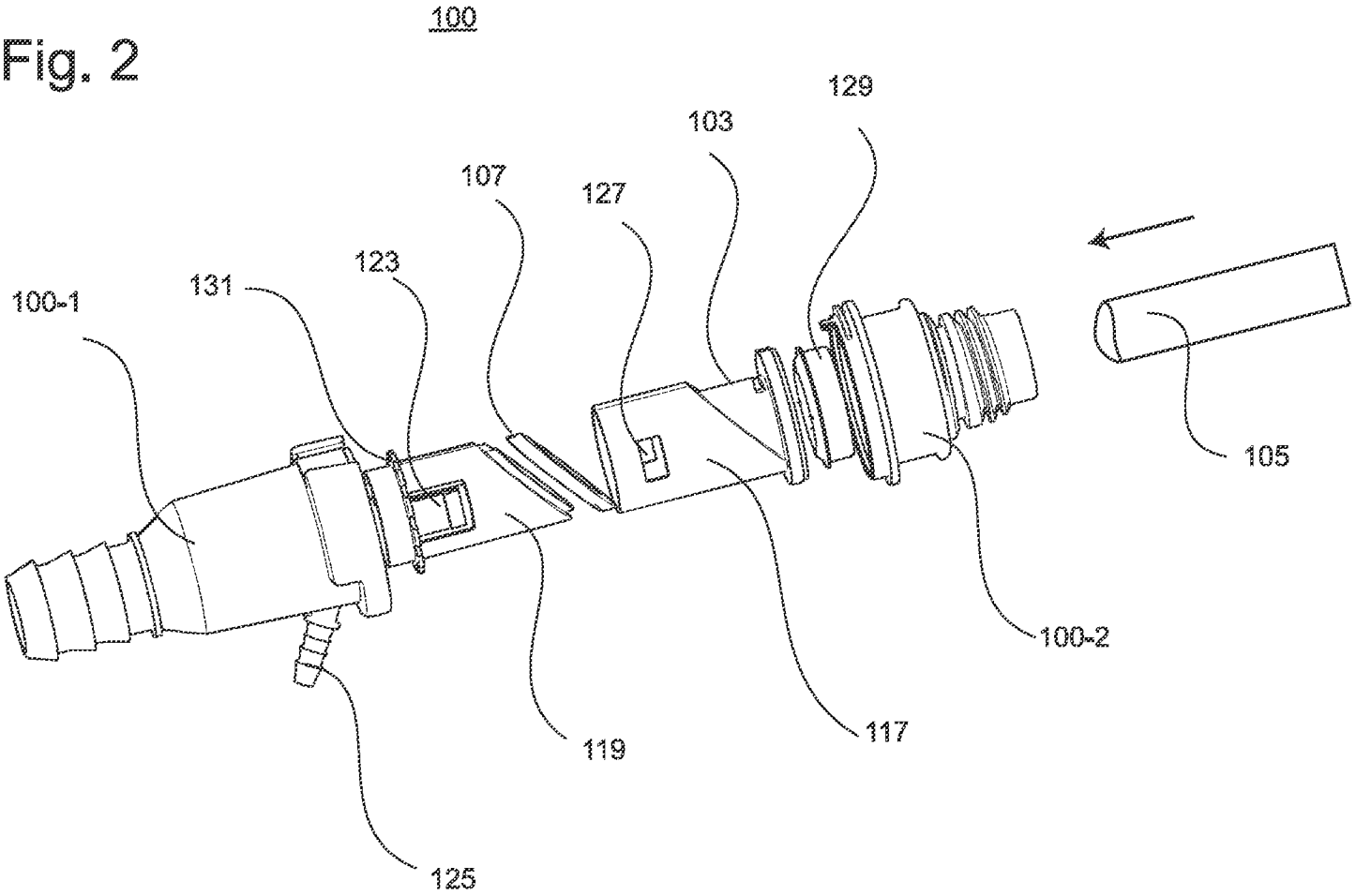
FIG. 2 shows an exploded view of the filling head.

FIG. 2 shows an exploded view of the filling head 100 and of the individual parts thereof. The filling head 100 comprises a moulded dip tube body 103 having a first moulded component 117 and a second moulded component 119. A seal element 107, which seals off the joint between the first moulded component 117 and the second moulded component 119, is arranged between the first moulded component 117 and the second moulded component 119. The first moulded component 117, the second moulded component 119 and the seal element 107 form the moulded dip tube body 103.

The first moulded component 117 forms part of a filler stub 104 in the interior of the filling head 100. The second moulded component 119 forms a component which projects beyond the inserted filling nozzle 105 and is used to shape and centre a liquid jet emerging from the filling nozzle 105 during tank filling.

Shaping of the liquid jet by means of the second moulded component 119 ensures tank filling with a high flow rate and prevents accumulation of the liquid in the interior of the filling head 100. It is particularly advantageous if the second moulded component 119 is cylindrical or tubular with parallel walls since it is thereby possible to produce laminar liquid flow.

The first moulded component 117 is furthermore used to fix an annular magnet 129 in the interior of the filling head 100. The annular magnet 129 is inserted in a cavity between the first moulded component 117 and the second filling head part 100-2. The annular magnet 129 produces a permanent magnetic field, which can be sensed by a filling nozzle 105 in order to determine the correct position of the filling nozzle 105 in the interior of the filling head 100. In addition, stop rims ensure the correct position. The first moulded component 117 furthermore comprises two lateral latching openings 127 for the engagement of a latching hook 123.

The annular magnetic 129 as a magnet element is formed from a magnetic plastics material. The magnet element retains a static magnetic field without the need for a flow of electric current. For this purpose, magnetic or magnetizable fillers can be added to a plastic. The magnet element can be produced by means of an injection moulding process, for example, and can be introduced into a magnetic field during or after injection moulding in order to magnetize it.

The plastic is, for example, a thermoplastic compound which contains polyamides, such as PA-6 or PA-12 or polyphenylene sulphide PPS as a carrier polymer, preferably PA-12, particularly preferably PPS containing fillers comprising hard ferrite or rare earth compounds. Sr or Ba ferrites are preferably used as hard ferrite compounds. NdFeB, SmCo or SmFeN can be used as rare earth compounds. The preferred thermoplastic compounds containing hard ferrite compounds have a coercive field strength (HcJ) of 200 to 300 KA/m, for example.

The second moulded component 119 comprises two latching hooks 123 for engagement in the latching openings 127 in the first moulded component 117. During the assembly of the first moulded component 117 and the second moulded component 119, the latching hooks 123 latch into the latching opening 127 and a firm connection is formed, which can be produced in a simple manner. In general, however, it is also possible to use different latching means as long as they bring about a mechanical connection between the first moulded component 117 and the second moulded component 119.

An anti-surge wall 131, which is circular for example, is arranged at the lower end of the second moulded component 119, inhibiting liquid flow into a liquid reservoir between the moulded dip tube body 103 and a housing wall of the filling head 100. The returning liquid is slowed down by the anti-surge wall 131 and the filling head 100 is prevented from being completely flooded. Nonetheless, it should be possible to fill the liquid reservoir with a sufficient residual quantity of liquid when topping up.

The seal element 107 projects into the interior of the moulded dip tube body 103 and seals off the filling nozzle 105 from the moulded dip tube body 103 since the seal element 107 rests laterally around the circumference of the filling nozzle 105. This prevents liquid from splashing back between the filling nozzle 105 and the moulded dip tube body 103. The seal element 107 extends diagonally around the filling nozzle 105 along the longitudinal axis of the filling head 100. By means of this arrangement, it is possible to achieve the technical advantage that the sealing effect of the filling head 100 is increased, the filling nozzle 105 is sealed off as far into the interior of the filling head 100 as possible and an opening for an automatic pump nozzle mechanism remains uncovered at the lower end of the filling nozzle 105. The automatic pump nozzle mechanism ensures that the tank filling operation is ended automatically when the liquid tank is full.

Figure 3:
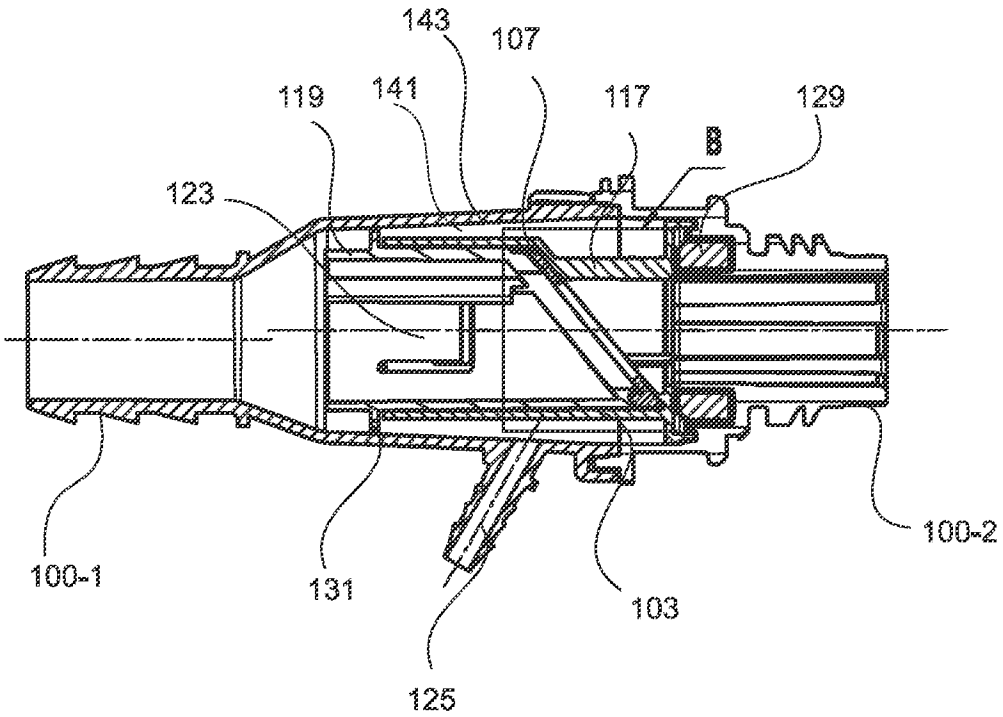
FIG. 3 shows a cross-sectional view of the filling head.
Figure 3:
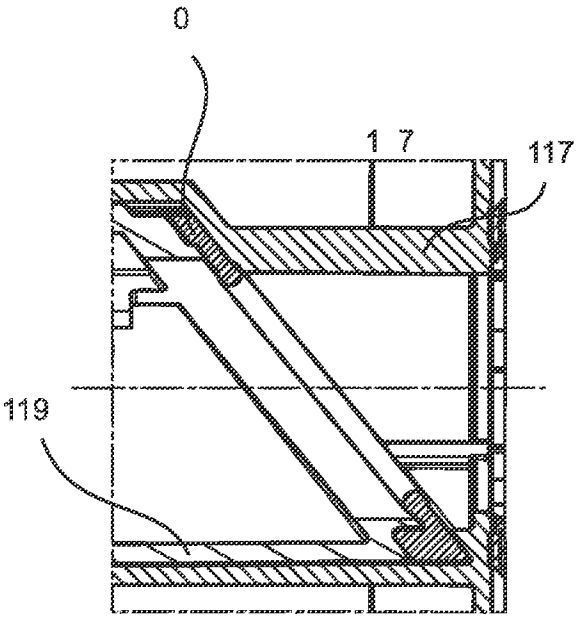

FIG. 3 shows a cross-sectional view of the filling head 100. The filling head 100 includes the liquid reservoir 141 between the housing wall 143 and the moulded dip tube body 103. The liquid reservoir 141 forms a cylindrical cavity in which a quantity of liquid slopping back out of the tank or a quantity of liquid flowing out of the filling nozzle 105 during topping up can be held. An escape of liquid from the filling head 100 is thereby avoided.

The anti-surge wall 131 is arranged at the lower end of the moulded dip tube body 103, at the inlet of the liquid reservoir 141. Liquid which flows into or out of the liquid reservoir 141 passes through the anti-surge wall 131. As a result, flow into the liquid reservoir 141 can be inhibited, thus preventing liquid from escaping from the filling head 100. For this purpose, passage openings 145, which determine the flow into the liquid reservoir 141, are formed in the anti-surge wall 131. The size, number and position of the passage openings 145 is matched to the magnitude of this flow.

It is advantageous if the liquid reservoir 141 has a volume of at least 160 ml to 200 ml since, in this case, an escape of liquid from the filling head 100 can be avoided even in the case of triple topping up with an automatic pump nozzle mechanism.

Figure 4:
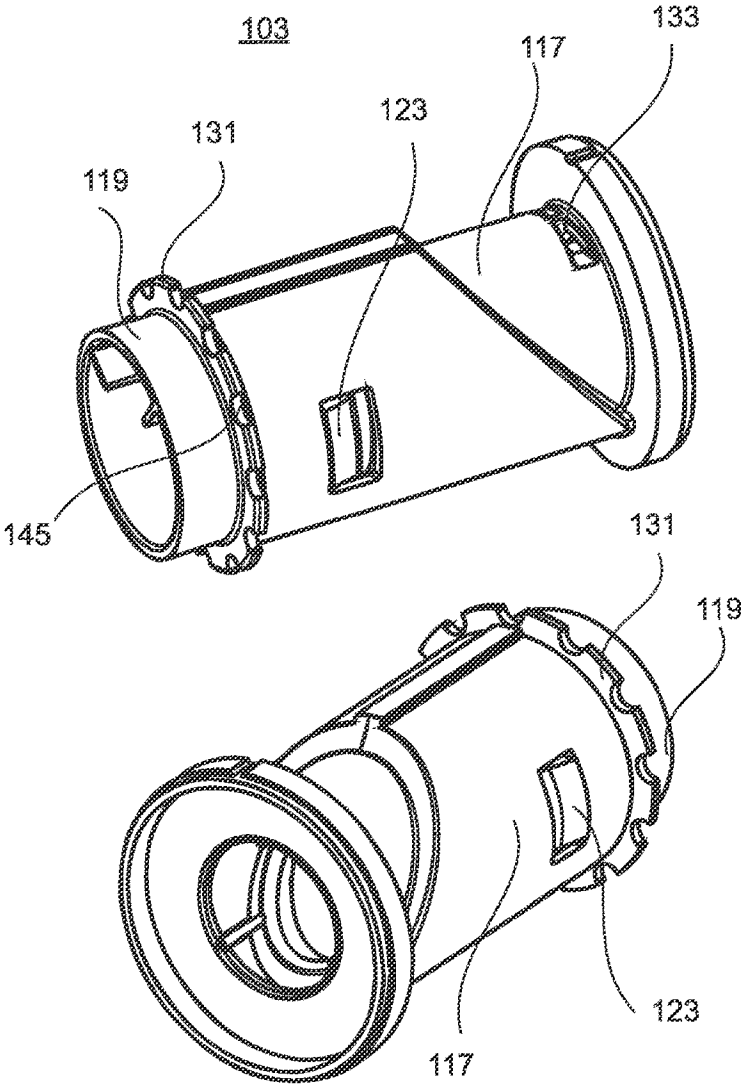
FIG. 4 shows a perspective view of a moulded dip tube body.

FIG. 4 shows a perspective view of a moulded dip tube body 103. At the upper end of the first moulded component 117 there is an opening 133, from which air can escape from the liquid reservoir 141, thus preventing the formation of an air buffer in the liquid reservoir 141. A pressure buffer could prevent the liquid reservoir 141 from being flooded, e.g. during a topping-up process, with the result that liquid could escape from the filling head 100. The size and position of the opening 133 are matched to the operation of the filling head 100 and to the liquid reservoir 141.

Figure 5:
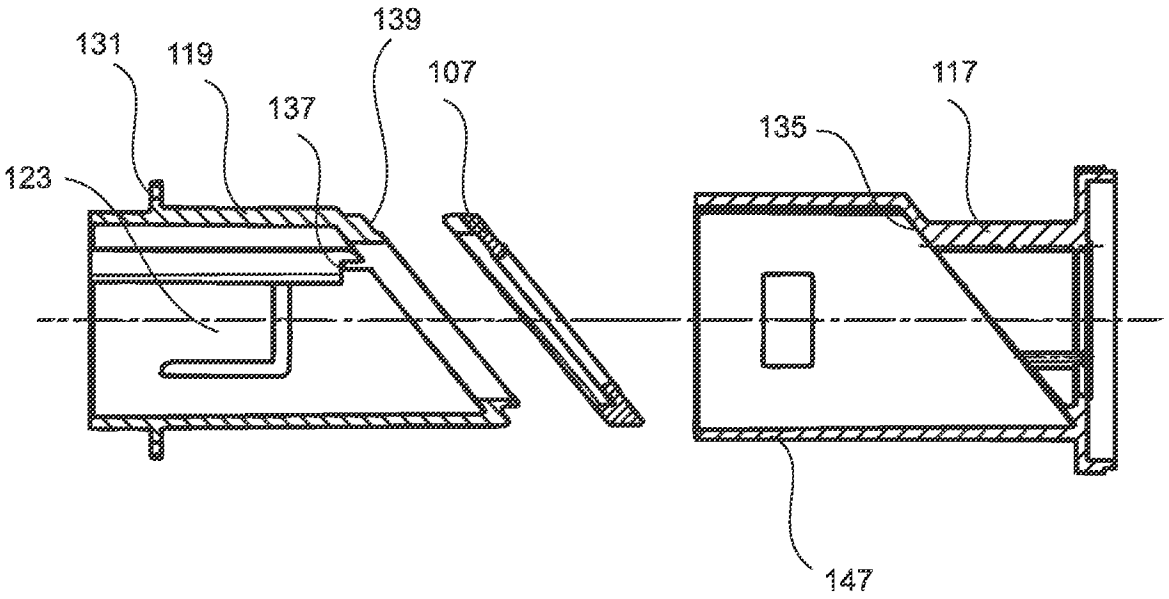
FIG. 5 shows a cross-sectional view of the moulded dip tube body with assembled moulded body components.

FIG. 5 shows a cross-sectional view of the moulded dip tube body 103 with separated moulded body components 117 and 119. The first moulded component 117 has a supporting surface 135 for the seal element 107 which runs diagonally around the longitudinal axis of the filling head 100. The seal element 107 rests on the supporting surface 135. In a corresponding way, the second moulded component 119 comprises a further supporting surface 139, on which an opposite side of the seal element 107 rests.

In another embodiment, the first moulded component 117 has a supporting surface 135 for the seal element 107 which runs vertically around the longitudinal axis of the filling head 100, wherein the seal element 107 runs vertically around the longitudinal axis of the filler stub 104. In a corresponding way, the second moulded component 119 comprises a further supporting surface 139, which runs vertically around the longitudinal axis of the filling head 100 and on which an opposite side of the seal element 107 rests.

During the assembly of the moulded dip tube body 103, the seal element 107 is clamped between the supporting surfaces 135 and 139 and held by said surfaces. The advantage that the sealing effect of the seal element 107 within the moulded dip tube body 103 is improved is thereby achieved.

Moreover, the moulded dip tube body 103 comprises a stop portion 137 for forming a stop for the filling nozzle 105. The stop portion 137 is formed on the inside of the second moulded component 119, with the result that the filling nozzle 105 strikes the stop portion 137 with its front end as it is introduced into the filler stub 104. The stop portion 137 is formed, for example, by a wall portion which projects into the interior of the second moulded part 119 and extends along the filling direction. In this way, swirling of the liquid can be prevented, even at high filling rates. The first moulded component 117 comprises an encircling wall 147, which comprises a cylindrical receiving space for receiving the second moulded component 119.

Figure 6:
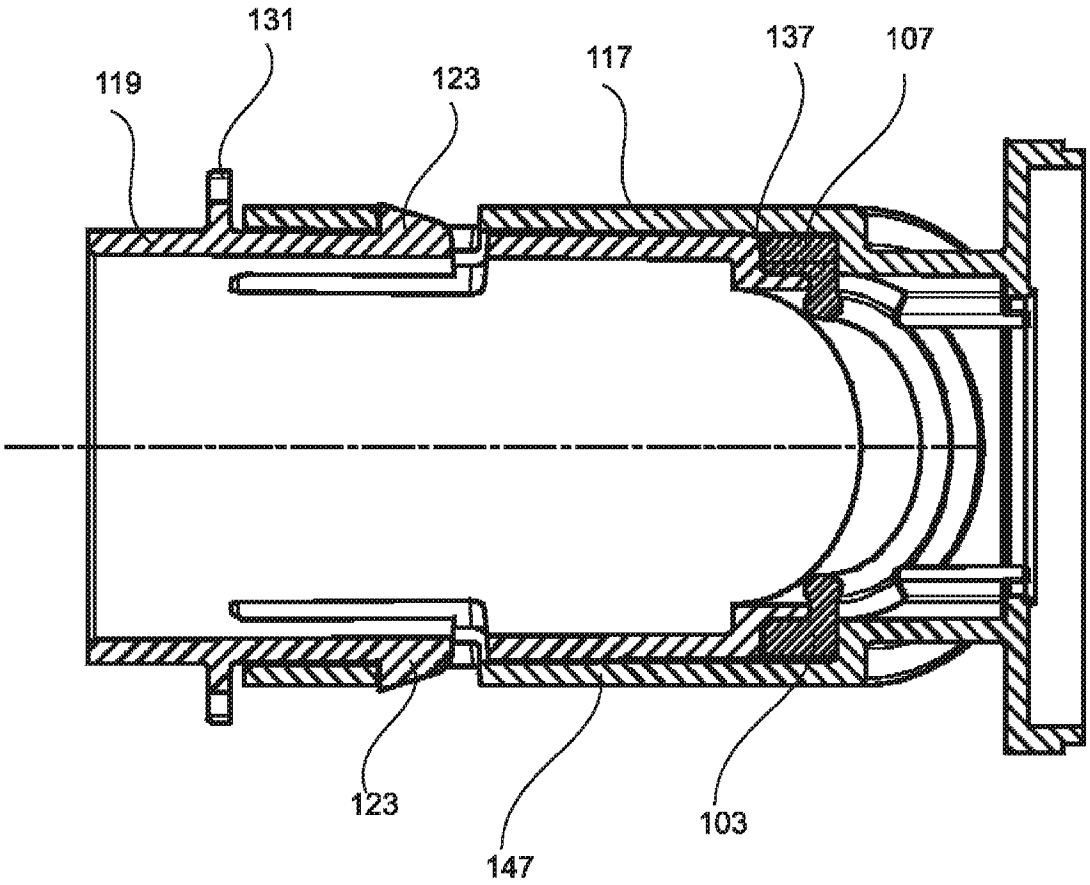
FIG. 6 shows a cross-sectional view of the moulded dip tube body with assembled moulded body components.

FIG. 6 shows a cross-sectional view of the moulded dip tube body 103 with assembled moulded body components 117 and 119 and the seal element 107. The first moulded component 117 is configured in such a way that a wall 147 laterally surrounds the second moulded component 119. The second moulded component 119 is accommodated in the first moulded component 117. As a result, there is an additional increase in the sealing effect between the two moulded components 117 and 119. The latching hooks 123 are hooked into the latching openings 127.

The second moulded component 119 has an encircling recess 137 in the supporting surface for positive-locking insertion of a projecting portion of the seal element 107 in the moulded dip tube body 103. Not only is the sealing effect of the seal element 107 thereby increased but a correct position of the seal element 107 during the assembly of the moulded dip tube body 103 can also be ensured. Moreover, retention of the seal element 107 between the first moulded component 117 and the second moulded component 119 is improved.

In another embodiment, the seal element 107 runs vertically around the longitudinal axis of the filler stub 104, wherein the second moulded component 119 has an encircling recess 137 in the supporting surface for positive-locking insertion of a projecting portion of the vertically arranged seal element 107 in the moulded dip tube body 103.

A positioning tongue, which engages in a positioning groove in the seal element 107, by means of which the correct seating of the seal element 107 when the moulded body is being assembled is ensured can additionally be provided in the second moulded component 119.

Figure 7:
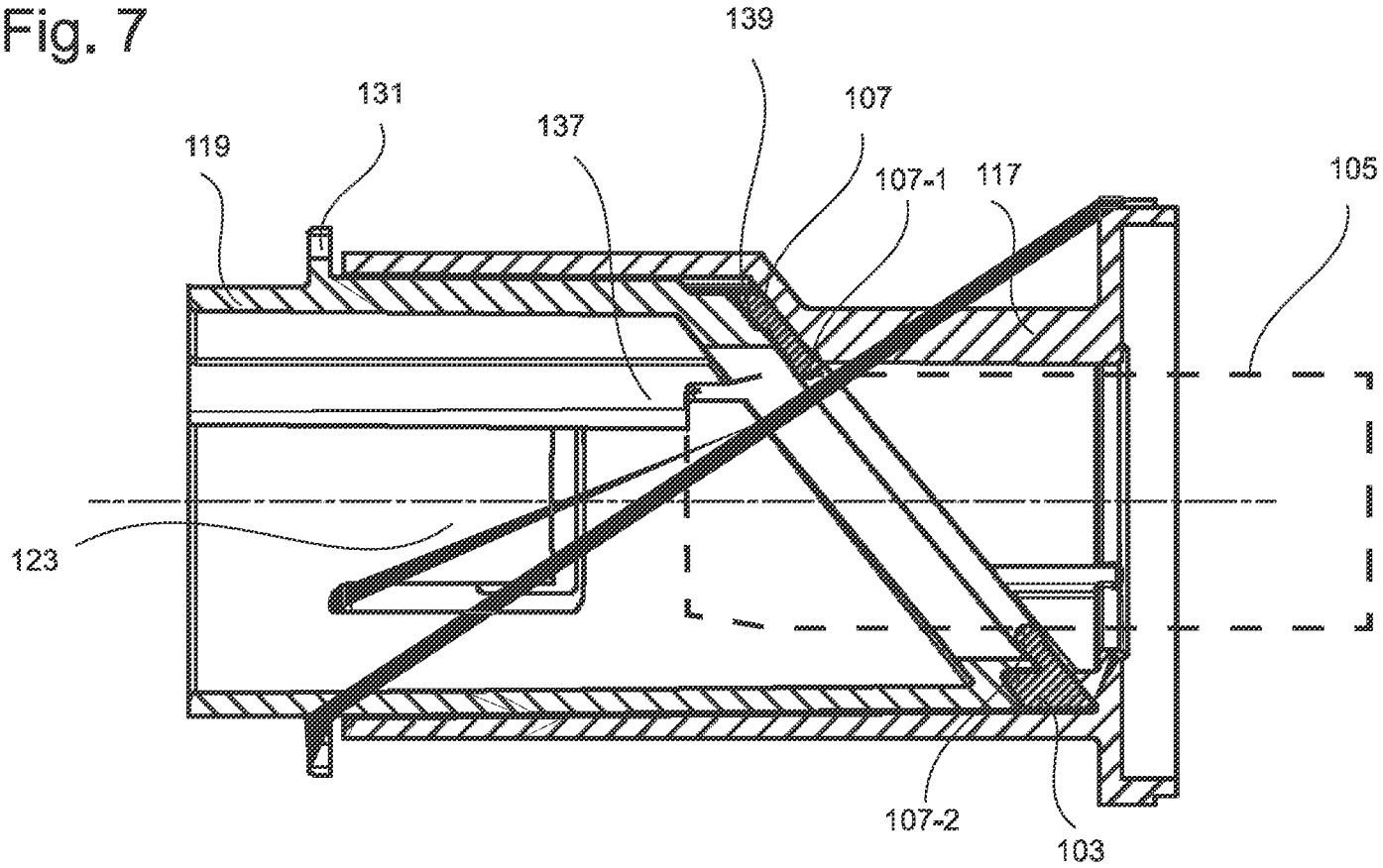
FIG. 7 shows another cross-sectional view of the moulded dip tube body with assembled moulded body components.

FIG. 7 shows a cross-sectional view of the moulded dip tube body 103 with assembled moulded body components 117 and 119, in which a dashed line indicates the position of the inserted filling nozzle 105. Positions 107-1 and 107-2 are the points in the cross-sectional plane at which the filling nozzle 105 rests on the seal element 107.

In another embodiment, the second moulded component 119 comprises a further supporting surface 139, which runs vertically around the longitudinal axis of the filling head 100 and on which the seal element 107 rests, wherein the seal element 107 runs vertically around a longitudinal axis of the filler stub 104. Locations 107-1 and 107-2 are the locations in the cross-sectional plane at which the filling nozzle 105 rests on the seal element 107, wherein the locations 107-1 and 107-2 are arranged vertically around the longitudinal axis of the filler stub 104.

The sealing line running diagonally or vertically around the filling nozzle 105 prevents splashback of the liquid.

Figure 8:
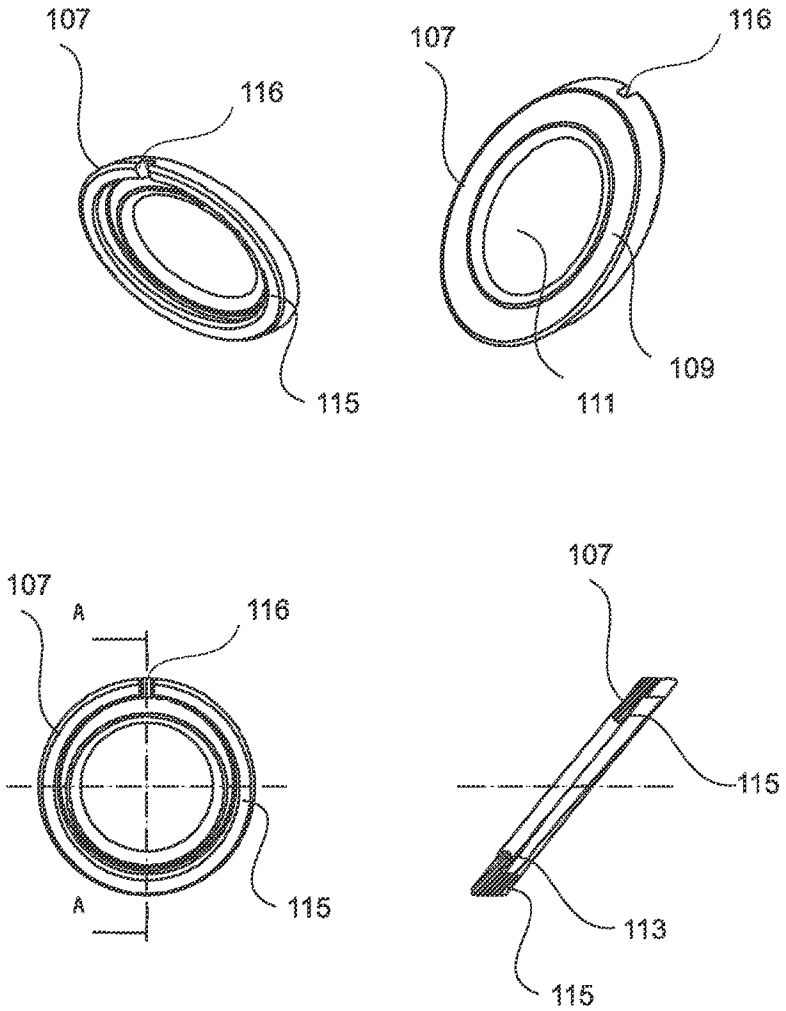
FIG. 8 shows a plurality of views of a seal element.

FIG. 8 shows a number of views of a seal element 107. The seal element 107 is situated in the filler stub 104, which is formed by the moulded dip tube body 103 and the first filling head part 100-1. The seal element 107 runs around diagonally in the longitudinal direction of the filler stub 104 in order to seal off the filler stub 104 from the filling nozzle 105. The seal element 107 can comprise a material which prevents the formation of urea crystals on the surface thereof.

The seal element 107 is formed by a flexible annular washer 109 with an oval insertion opening 111 for the insertion of the filling nozzle 105. In the case of diagonal arrangement of the seal element 107, the oval insertion opening 111 comes to rest on the outside of the filling nozzle 105, which has a circular cross section.

In another embodiment, the seal element 107 is situated in the filler stub 104, which is formed by the moulded dip tube body 103 and the first filling head part 100-1, wherein the seal element 107 runs vertically around the longitudinal axis of the filler stub 104 in order to seal off the filler stub 104 from the filling nozzle 105. The seal element 107 is formed by a flexible annular washer 109 with a round insertion opening 111 for the insertion of the filling nozzle 105. In the case of vertical arrangement of the seal element 107, the round insertion opening 111 comes to rest on the outside of the filling nozzle 105, which has a circular cross section.

The diagonal or vertical position of the seal element 107 ensures that the differently arranged openings in nozzle guns are not covered relative to the automatic pump nozzle mechanism and switching off of the respective nozzle gun remains possible. In the case of a vertical position of the seal element 107, it is furthermore ensured that the seal can be positioned in such a way that the automatic shut-off mechanism on all nozzle guns is free and hence that the pump nozzle can be used for tank filling with free rotation through 360°.

The annular washer 109 comprises a reinforcing portion 113 for reinforcing the seal element 107 in the region of the insertion opening 111. The reinforcing portion 113 can be formed, for example, by a region with a greater thickness than the thickness of the remainder of the annular washer 109, e.g. by an encircling annular bead 115. As a result, the inner seal edge of the seal element 107 is not only reinforced but, in addition, is also rounded off, thus facilitating insertion of the filling nozzle 105.

To accommodate the seal element 107, the moulded dip tube body 103 has a recess for the insertion of the seal element 107. In particular, the recess for the insertion of the seal element 107 is formed between a first moulded component 117 and a second moulded component 119, between two supporting surfaces 135 and 139. Both the first moulded component 117 and the second moulded component 119 can include the recess for the insertion of the seal element 107.

The seal element 107 has an encircling projecting rim 115, which is inserted into a corresponding annular recess in the filler stub 104 and additionally fixes the seal element 107 in the filler stub 104. Moreover, the seal element 107 comprises a positioning groove 116 for engagement in a corresponding positioning tongue, by means of which the correct seating of the seal element 107 can be ensured. The seal element 107 can be formed from any suitable sealing materials, e.g. polyurethane, silicone, silane-modified polymers, thermoplastic elastomers (TPE) or rubber.

Figure 9:
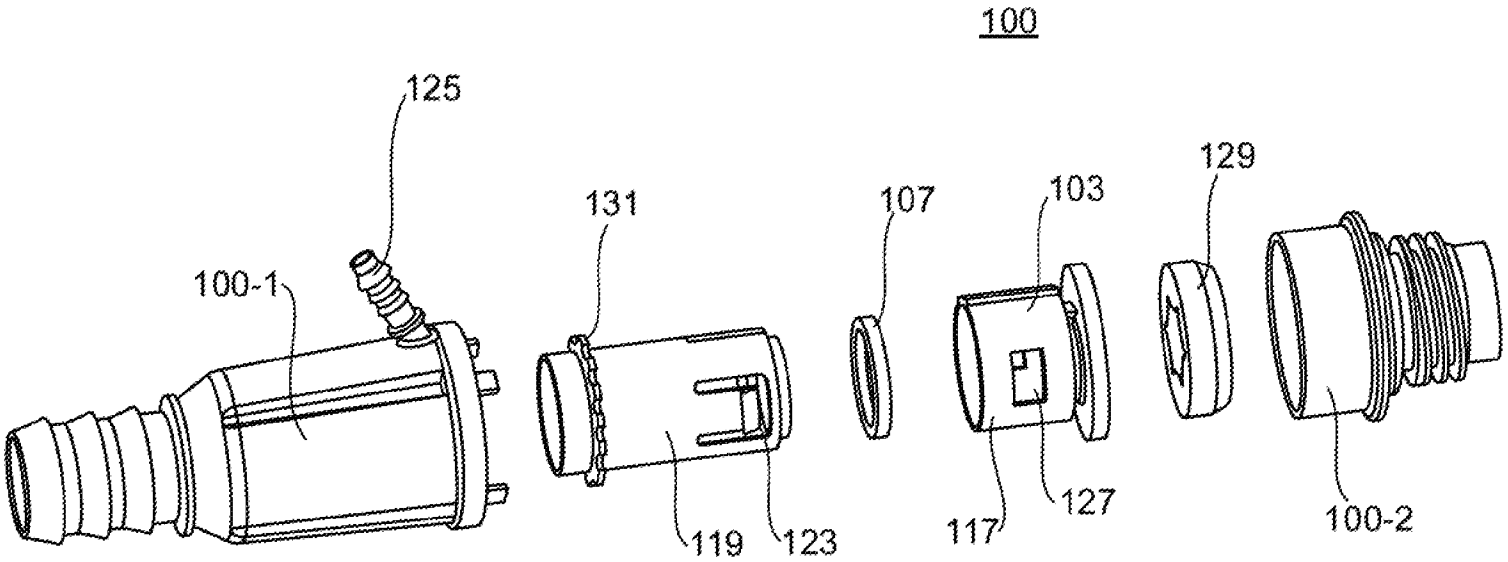
FIG. 9 shows an exploded view of another embodiment of the filling head.

FIG. 9 shows an exploded view of another embodiment of the filling head 100 and of the individual parts thereof. The filling head 100 comprises a moulded dip tube body 103 having a first moulded component 117 and a second moulded component 119. Arranged between the first moulded component 117 and the second moulded component 119 is a seal element 107, which seal off the joint between the first moulded component 117 and the second moulded component 119. The first moulded component 117, the second moulded component 119 and the seal element 107 form the moulded dip tube body 103.

The first moulded component 117 is furthermore used to fix an annular magnet 129 in the interior of the filling head 100. The annular magnet 129 is inserted in a cavity between the first moulded component 117 and the second filling head part 100-2. The first moulded component 117 furthermore comprises two lateral latching openings 127 for the engagement of a latching hook 123.

The second moulded component 119 comprises two latching hooks 123 for engagement in the latching openings 127 in the first moulded component 117. During the assembly of the first moulded component 117 and the second moulded component 119, the latching hooks 123 latch into the latching opening 127 and a firm connection is formed, which can be produced in a simple manner. In general, however, it is also possible to use different latching means as long as they bring about a mechanical connection between the first moulded component 117 and the second moulded component 119.

An anti-surge wall 131, which is circular for example, is arranged at the lower end of the second moulded component 119, inhibiting liquid flow into a liquid reservoir between the moulded dip tube body 103 and a housing wall of the filling head 100.

The seal element 107 projects into the interior of the moulded dip tube body 103 and seals off the filling nozzle 105 from the moulded dip tube body 103 since the seal element 107 rests laterally around the circumference of the filling nozzle 105. This prevents liquid from splashing back between the filling nozzle 105 and the moulded dip tube body 103. The seal element 107 extends vertically around the filling nozzle 105 along the longitudinal axis of the filling head 100. By means of this arrangement, it is possible to achieve the technical advantage that the entire filling head 100 can be of smaller design through the vertical arrangement of the seal. Moreover, the vertical design allows the seal to be positioned in such a way that the automatic shut-off mechanism on all nozzle guns is free and hence that the pump nozzle can be used for tank filling with free rotation through 360°.

Figure 10A:
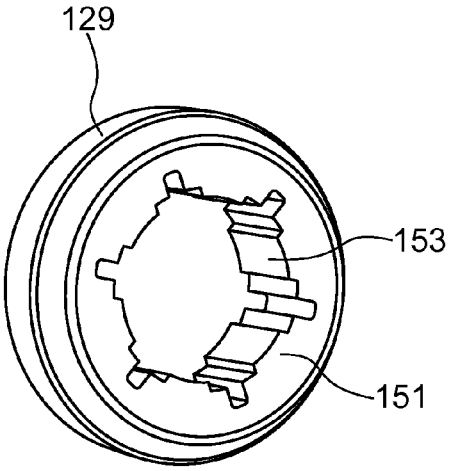
FIGS. 10A, 10B, and 10C show a magnet composed of magnetizable plastics compound.
Figure 10B:
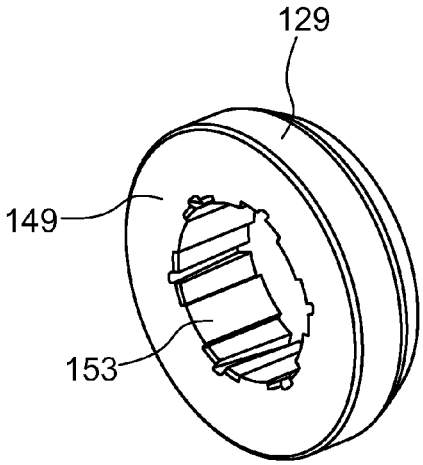
Figure 10C:
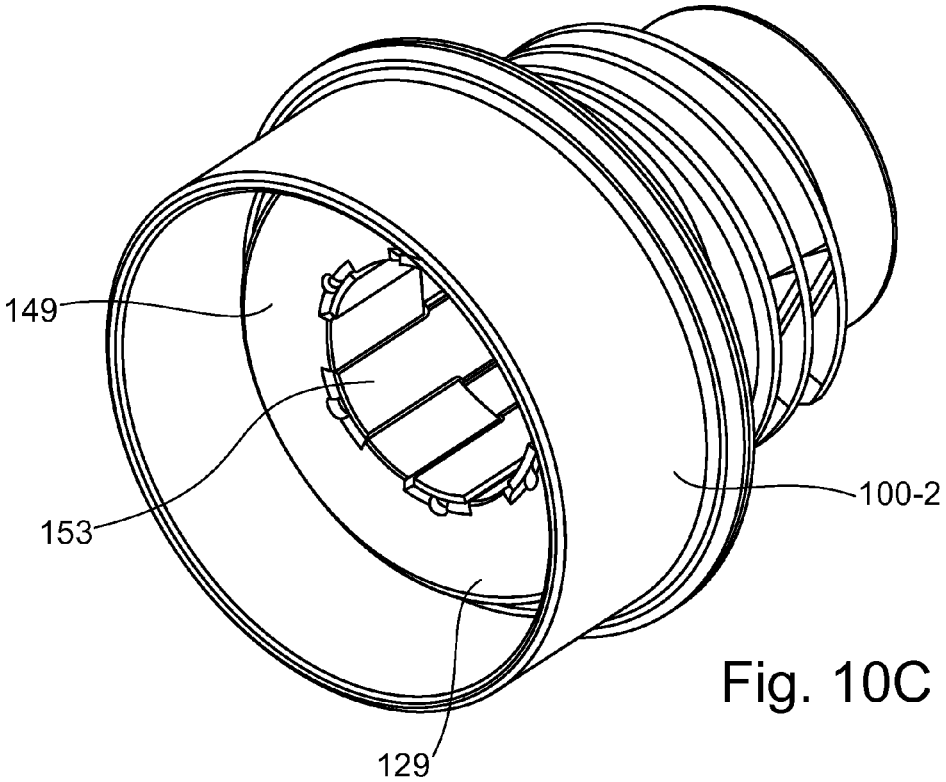

FIGS. 10A, 10B, and 10C show a magnet composed of magnetizable plastics compound. The annular magnet 129 shown in FIG. 10A and FIG. 10B has a flat underside 149, a rounded upper side 151 and an aperture 153, wherein the aperture 153 can have any geometrical shapes. In an alternative embodiment, the aperture 153 can be arranged not in the interior of the annular magnet 129 but, instead, on the outer side of the annular magnet 129. The annular magnet 129 as a magnet element is formed from a magnetic plastics material. The magnet element retains a static magnetic field without the need for a flow of electric current. For this purpose, magnetic or magnetizable fillers can be added to a plastic. The magnet element can be produced by means of an injection moulding process, for example, and can be introduced into a magnetic field during or after injection moulding in order to magnetize it.

According to FIG. 10C, the annular magnet 129 is inserted in a cavity in the second filling head part 100-2. The annular magnet 129 produces a permanent magnetic field, which can be sensed by a filling nozzle 105 in order to determine the correct position of the filling nozzle 105 in the interior of the filling head 100. To enable the annular magnet 129 to produce an effective magnetic field, the annular magnet 129 must be inserted in a directionally selective manner into the cavity in the second filling head part 100-2. During the insertion of the annular magnet 129 into the second filling head part 100-2, the design of the aperture 153 can thus ensure the required orientation of the directional magnet 129 in the second filling head part 100-2. The required orientation of the magnetic field produced by the annular magnet 129 can thus be ensured.

By means of the filling head 100 according to the invention, different nozzle guns and GL adapters for canisters and Kruse bottles can be received. Switching of an automatic pump nozzle mechanism, e.g. that of a gun with an automatic pump nozzle mechanism, is performed by means of the annular magnet 129 of the filling head 100. Moreover, ventilation is performed during tank filling with a Kruse bottle and a canister via a connection stub 124 for a ventilation line.

By virtue of the liquid reservoir 141, the filling head 100 is furthermore configured in such a way that spit back can be accommodated. The filling head 100 allows pressure reduction and standardizes the liquid jet from different nozzle guns during filling. Liquid spit back is effectively prevented. When using the filling head 100 for filling with an aqueous urea solution, crystal formation in the interior of the filling head 100 can be prevented by a leaktight cap, which is screwed on and is not shown in the figures.

In particular, the filling head 100 allows filling rates of 40 l/min with a small, compact filling head 100 without the occurrence of liquid spit back. Owing to the arrangement, position and shape of the seal element 107, it is possible to top up three times without liquid escaping.

The tank filling process with the filling head 100 is initiated by manual actuation of the nozzle gun. Via the filling head 100, the liquid passes into the liquid tank after opening a flap valve, and the liquid tank is filled with an aqueous urea solution. In the liquid tank, the liquid displaces air, which escapes via a vent valve. The liquid level then rises as far as the moulded dip tube body 103, and the tank internal pressure and the liquid level rise. A float valve closes and the liquid reaches the filling nozzle 105 of the nozzle gun, the automatic pump nozzle mechanism of which then switches off. A flap valve closes and the tank filling process is at an end.

All the features explained and shown in connection with individual embodiments of the invention can be provided in a different combination in the subject matter according to the invention in order to achieve the advantageous effects thereof The scope of protection of the present invention is given by the claims and is not restricted by the features explained in the description or shown in the figures.

LIST OF REFERENCE SIGNS

100 filling head
100-1 filling head part
100-2 filling head part
103 moulded dip tube body
104 filler stub
105 filling nozzle
107 seal element
109 annular washer
111 insertion opening
113 reinforcing portion
115 bead
116 positioning groove
117 first moulded component
119 second moulded component
123 latching hook
127 latching opening
129 annular magnet/magnet element
131 anti-surge wall
133 opening
135 supporting surface
137 stop portion
139 supporting surface
141 liquid reservoir
143 housing wall
145 passage opening
147 wall
149 underside of the annular magnet
151 upper side of the annular magnet
153 aperture in the annular magnet

The invention claimed is:

1. A filling head having a filler stub for a pump nozzle, having:

a magnet element, which is formed from a magnetic plastics material, for releasing an automatic pump nozzle mechanism of the pump nozzle;

wherein the magnetic plastics material comprises a thermoplastic material, the thermoplastic material comprising one or more of hard ferrite and rare earth fillers;

wherein the filling head comprises an assembled molded dip tube body in the interior of the filling head, the assembled molded dip tube body comprising a first molded body component for forming a filler stub for a filling nozzle, and a second molded body component for shaping a liquid jet of the filling nozzle, the second molded body component fastened on the first molded body component;

wherein the first molded body component and the second molded body component, together with a housing wall of the filling head, form a liquid reservoir for holding a liquid quantity;

wherein the first molded body component comprises an opening for allowing air out of the liquid reservoir; and wherein the opening is formed at the upper end of the first molded body component in the vicinity of a connection of the first molded body component to the filling head.

2. The filling head according to claim 1, wherein the second molded body component comprises an encircling circular anti-surge wall for reducing liquid flow into the liquid reservoir.

3. The filling head according to claim 2, wherein the encircling anti-surge wall comprises a passage opening for liquid flow into the liquid reservoir.

4. The filling head according to claim 1, wherein the molded dip tube body has a cylindrical basic shape.

5. The filling head according to claim 4, wherein a seal element between the first molded body component and the second molded body component seals off the filler stub.

6. The filling head according to claim 5, wherein the seal element runs diagonally or vertically around a longitudinal axis of the filler stub.

7. The filling head according to claim 5, wherein the first molded body component or the second molded body component comprises a supporting surface for the seal element.

8. The filling head according to claim 1, wherein the first molded body component comprises a latching means for latching in the second molded body component, or the second molded body component comprises a latching means for latching in the first molded body component.

9. The filling head according to claim 1, wherein the second molded body component comprises a stop portion for forming a stop for the filling nozzle.

10. The filling head according to claim 1, wherein the molded dip tube body is welded or adhesively bonded to the filling head.

11. The filling head according to claim 1, wherein the first molded body component comprises an encircling wall for laterally enclosing the second molded body component.

* * * * *